US009303930B2

(12) United States Patent
Ishizaka

(10) Patent No.: US 9,303,930 B2
(45) Date of Patent: Apr. 5, 2016

(54) AIR CONDITIONER CONTROL DEVICE, AIR CONDITIONER CONTROL METHOD, AND PROGRAM

(75) Inventor: Taichi Ishizaka, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 470 days.

(21) Appl. No.: 13/822,719

(22) PCT Filed: Jan. 27, 2011

(86) PCT No.: PCT/JP2011/051657

§ 371 (c)(1),
(2), (4) Date: Mar. 13, 2013

(87) PCT Pub. No.: WO2012/053230

PCT Pub. Date: Apr. 26, 2012

(65) Prior Publication Data

US 2013/0168038 A1 Jul. 4, 2013

(30) Foreign Application Priority Data

Oct. 18, 2010 (JP) ..... 2010-233845

(51) Int. Cl.
*G05B 21/00* (2006.01)
*G05B 13/00* (2006.01)
(Continued)

(52) U.S. Cl.
CPC ..... *F28F 27/00* (2013.01); *F24F 3/065* (2013.01); *F24F 11/006* (2013.01); *F24F 11/0034* (2013.01); *F24F 2011/0075* (2013.01)

(58) Field of Classification Search
CPC ..... G05B 19/042; G05B 15/02; F24F 3/065; H04N 7/15; G08B 13/196; G08B 5/221
USPC ..... 236/46, 49; 348/159
See application file for complete search history.

(56) References Cited

U.S. PATENT DOCUMENTS 4,407,447 A * 10/1983 Sayegh ..... 236/49.3
2010/0019051 A1* 1/2010 Rosen ..... 236/46 R
(Continued)

FOREIGN PATENT DOCUMENTS

JP 55-116040 A 9/1980
JP 11-287496 A 10/1999
(Continued)

OTHER PUBLICATIONS

Office Action dated Nov. 27, 2014 issued in corresponding CN patent application No. 201180049894.8 (and English translation).
(Continued)

*Primary Examiner* — Mohammad Ali
*Assistant Examiner* — MD Azad
(74) *Attorney, Agent, or Firm* — Posz Law Group, PLC

(57) ABSTRACT

An air conditioner control device controls a plurality of air conditioners installed at different positions in a predetermined living room space. A memory unit manages presence and absence data on people who are in a room air-conditioned by each of the air conditioners. Based on the managed presence and absence data, a number-of-people-in-the-room calculation unit calculates, on a per-air-conditioner basis, the number of people who are in the room air-conditioned by each of the air conditioners. A control time determination unit increases or decreases the control time during which an energy saving control of each of the air conditioners is executed, depending on the calculated number of people in the room. A control execution unit repeatedly executes the energy saving control of each of the air conditioners, according to the determined control time.

6 Claims, 11 Drawing Sheets

(51) Int. Cl.

| | |
|---|---|
| ***G05B 15/00*** | (2006.01) |
| ***G05D 23/00*** | (2006.01) |
| ***F24F 7/00*** | (2006.01) |
| ***F24H 9/20*** | (2006.01) |
| ***H04N 7/18*** | (2006.01) |
| ***F28F 27/00*** | (2006.01) |
| ***F24F 3/06*** | (2006.01) |
| *F24F 11/00* | (2006.01) |

(56) References Cited

U.S. PATENT DOCUMENTS

| | | | | |
|---|---|---|---|---|
| 2010/0174414 | A1* | 7/2010 | Takagi et al. | 700/278 |
| 2011/0205366 | A1* | 8/2011 | Enohara et al. | 348/159 |

FOREIGN PATENT DOCUMENTS

| | | | |
|---|---|---|---|
| JP | 2006-029693 | A | 2/2006 |
| JP | 2007-218499 | A | 8/2007 |
| JP | 2009-299933 | A | 12/2009 |
| JP | 2010-038375 | A | 2/2010 |
| JP | 2010-065968 | A | 3/2010 |

OTHER PUBLICATIONS

International Search Report of the International Searching Authority mailed Apr. 26, 2011 for the corresponding international application No. PCT/JP2011/051657 (with English translation).

* cited by examiner

FIG. 9

| | NUMBER OF PEOPLE IN A ROOM | CONTROL TIME |
|---|---|---|
| AIR CONDITIONER 01 | 4 | 30 × (12 − 4)/48 = 5.0 |
| AIR CONDITIONER 02 | 2 | 30 × (12 − 2)/48 = 6.25 |
| AIR CONDITIONER 03 | 3 | 30 × (12 − 3)/48 = 5.625 |
| AIR CONDITIONER 04 | 3 | 30 × (12 − 3)/48 = 5.625 |
| AIR CONDITIONER 05 | 0 | 30 × (12 − 0)/48 = 7.5 |

AIR CONDITIONER CONTROL DEVICE, AIR CONDITIONER CONTROL METHOD, AND PROGRAM

CROSS REFERENCE TO RELATED APPLICATIONS

This application is a U.S. national stage application of PCT/JP2011/051657 filed on Jan. 27, 2011, and claims priority to, and incorporates by reference, Japanese Patent Application No. 2010-233845 filed on Oct. 18, 2010.

TECHNICAL FIELD

The present invention relates to an air conditioner control device, an air conditioner control method, and a program for performing energy-saving control of a plurality of air conditioners that are located at different positions in an inhabited space in a building or the like.

BACKGROUND ART

In recent years, air conditioner control devices have appeared that execute energy-saving control of an air conditioner by restricting the air conditioning performance of the air conditioner. However, when energy-saving control of an air conditioner is performed without taking into consideration the conditions inside the air-conditioned room or space where the air conditioner is located, there is a possibility that the comfort of the people in the air-conditioned room may be decreased.

Therefore, operation control methods and systems for maintaining the comfort of the people in an air-conditioned room by detecting the temperature difference between the room temperature of the air-conditioned room and the outside temperature, and the positions of the people in the air-conditioned room, and changing the amount of correction for maximum performance for the air-conditioned room (for example, refer to Patent Literature 1).

In this operation control method, the positions of people in an air-conditioned room are found by human body detection sensors that are provided in the indoor device of an air conditioner, and when the air conditioned room becomes stable, the overall heat transfer coefficient of the air-conditioned room (found by dividing the amount of injected heat by the difference between the room temperature and outside temperature) is found, and energy-saving control of the air conditioner is performed according to positions of the people in the room and the overall heat transfer coefficient. As a result, it is possible to execute energy-saving control of the air conditioner without users of the air conditioner feeling uncomfortable even when executing operation that restricts the maximum performance.

Moreover, demand control systems and methods have been disclosed wherein, by performing energy-saving control for a specified time of each of a plurality of air conditioners while at the same time shifting the time period, sudden changes in temperature that cause people in a room to feel uncomfortable are reduced, and a certain amount of comfort is maintained while saving energy (for example, refer to Patent Literature 2).

PRIOR ART LITERATURE

Patent Literature

Patent Literature 1: Unexamined Japanese Patent Application Kokai Publication No. 2010-65968 (FIG. 1)

Patent Literature 2: Unexamined Japanese Patent Application Kokai Publication No. 2006-29693 (FIG. 4)

DISCLOSURE OF THE INVENTION

Problem to be Solved by the Invention

When performing operation control of an air conditioner with the operation control method disclosed in Patent Literature 1, and when occupants of an air-conditioned room are all located in the same direction from a given air conditioner, saving energy by blowing out air in only the same direction is possible. However, in a large inhabited space such as in an office in an office building, when people are located in many directions from a given air conditioner, it becomes difficult to obtain the objective effect of reducing power consumption while trying to maintain the comfort of all of the occupants.

The demand control system in Patent Literature 2 performs control by stopping the air conditioner regardless of the condition of the inhabited space only for a fixed control time while energy-saving control is executed. When performing this kind of stopping control, in an air-conditioned area where there are many people, for example, the temperature rises rapidly while the air conditioner is stopped, and in and air-conditioned area where there are few people, the temperature rise is gradual. Therefore, when the control time is fixed, there is a possibility that differences in comfort will occur according to the number of people in the air-conditioned area.

Taking into consideration the situation described above, the objective of the present invention is to provide an air conditioner control device, an air conditioner control method and a program capable of preventing a drop in comfort due to air conditioning, while at the same time maintaining the effect of reducing the amount of power used by performing energy-saving control.

Means for Solving the Problem

In order to accomplish the objective above, the air conditioner control device of the present invention controls a plurality of air conditioners that are installed at different positions in a specified inhabited space. In this air conditioner control device, a management unit manages information related to people in a space. A number-of-people-in-a-room calculation unit calculates, for each air conditioner, the number of people in a space that is air conditioned by an air conditioner based on the information related to people in the space that is managed by the management unit. A control time determination unit reduces or increases the control time during which energy-saving control of each of the air conditioners is executed per a unit time according to the number people in a space that was calculated by the number-of-people-in-a-room calculation unit. A control execution unit repeatedly executes energy-saving control for each of the air conditioners according to the control time that is reduced or increased by the control time determination unit.

Effects of the Invention

With the present invention, the control time during which energy-saving control is executed for each air conditioner is increased or decreased according to the number of occupants, which become a heat source, in spaces that are air conditioned by a plurality of air conditioners. In doing so, reduced variation in the temperature due to energy-saving control without changing the amount that power consumption has been reduced is possible, regardless of the number of people in an inhabited space. As a result, minimizing a drop in comfort due to air conditioning, while at the same time, maintaining the effect of reduced power consumption by energy-saving control is also possible.

BRIEF DESCRIPTION OF DRAWINGS

FIG. 9 is a drawing illustrating an example of calculation of the control time;

MODE FOR CARRYING OUT THE INVENTION

In the following, embodiments of the present invention will be explained in detail with reference to the accompanying drawings.

Embodiment 1

First, a first embodiment of the present invention will be explained.

Figure 1:
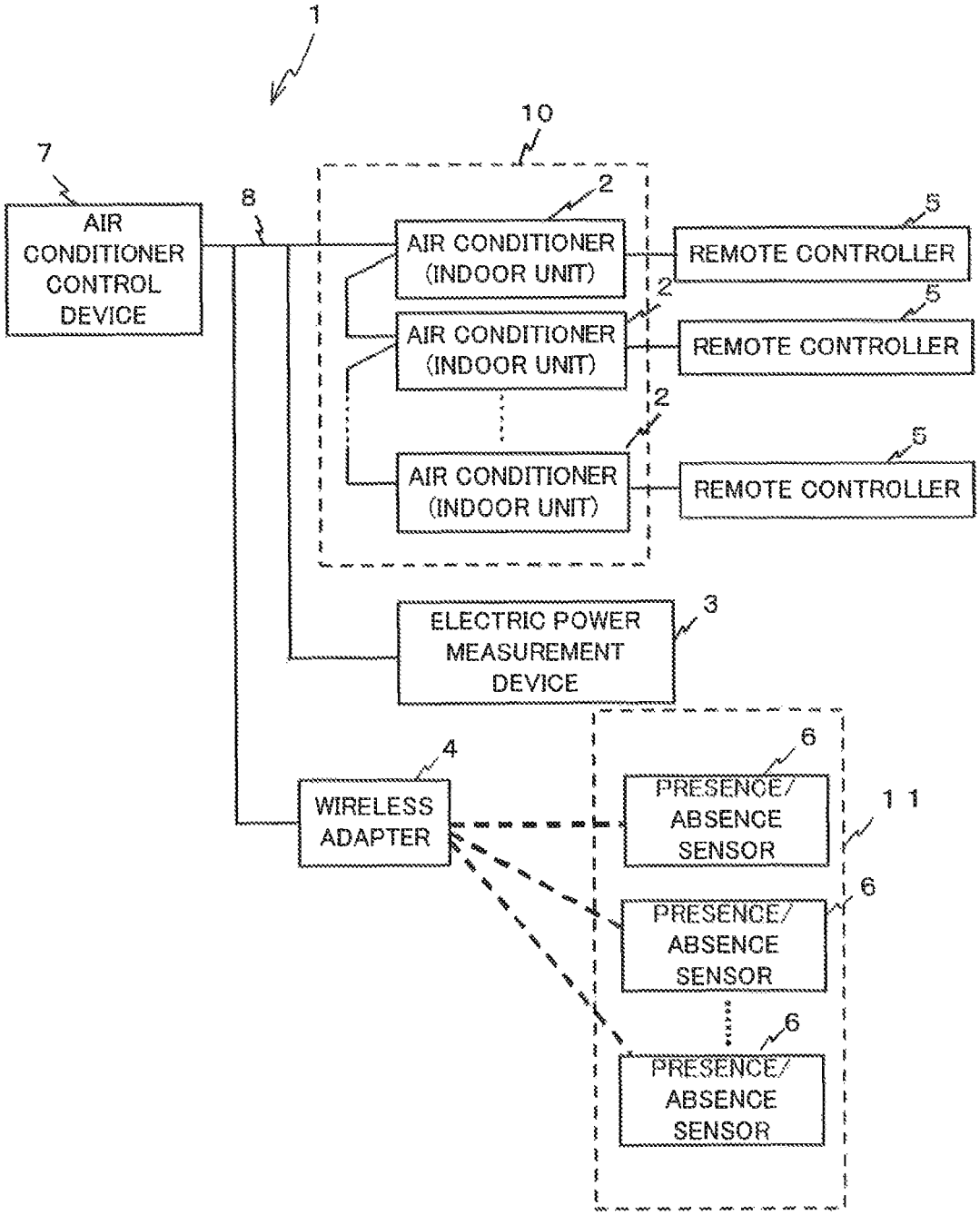
FIG. 1 is a block diagram illustrating the construction of an air conditioning system of a first embodiment of the present invention.

FIG. 1 illustrates the construction of an air conditioning system 1 of a first embodiment of the present invention. As illustrated in FIG. 1, the air conditioning system 1 of this embodiment is provided with a plurality of air conditioners (indoor units) 2, an electric power measurement device 3, a wireless adapter 4, remote controllers 5, presence/absence sensors 6 and an air conditioner control device 7.

The air conditioners (indoor units) 2, the electric power measurement device 3, the wireless adapter 4 and the air conditioner control device 7 are connected by dedicated communication lines 8 so as to be able to communicate with each other. Moreover, it is not particularly illustrated in FIG. 1, however, the air conditioner control device 7 is not only connected to the air conditioners (indoor units) 2, but is also connected to heat source units (outdoor units), which have compressors and the like, by way of dedicated communication lines 8 such that communication is possible.

Furthermore, the remote controllers 5 are connected to respective air conditioners (indoor units) 2 such that operation is possible. Moreover, the presence/absence sensors 6 are connected to the wireless adapter 4 such that wireless communication is possible and so as to be able to respond with information of whether or not people are nearby, or in other words, information indicating the presence or absence of people in the room.

Each of the plurality of air conditioners (indoor units) 2 is arranged at a different location inside a specified inhabited space. Each air conditioner (indoor unit) 2 performs air conditioning of its respective space under the control of the air conditioner control device 7 such that the temperature of that space approaches the target temperature setting. More specifically, each air conditioner (indoor unit) 2 receives various instructions from the air conditioner control device 7 such as a stop instruction, fan instruction, performance limit, temperature setting change instruction and the like that are used for energy-saving control, and performs air conditioning of the corresponding space according to the received instruction. This plurality of air conditioners (indoor units) 2 will hereafter also be called an air conditioner group 10.

The electric power measurement device 3 is a device for measuring the amount of electric power used by the air conditioning system 1 or the entire building. The amount of electric power measured by the electric power measurement device 3 is used for switching the control contents of the air conditioners (indoor units) 2.

The wireless adapter 4 performs data conversion between data having a format that is specified by the communication protocol for data flowing on dedicated communication lines 8, and data having a format specified by communication protocol for wireless communication. The air conditioner control device 7 and the presence/absence sensors 6 can communicate with each other by way of the wireless adapter 4.

The remote controllers 5 are operation terminals by which a user operates the air conditioners (indoor units) 2. By operating the remote controllers 5, it is possible to turn ON or turn OFF the corresponding air conditioner (indoor unit) 2, as well as change the operating mode between cooling and heating, and change the temperature setting, airflow direction and airflow speed.

The presence/absence sensors 6 are a way for detecting the presence or absence of people nearby. The presence/absence sensors 6, for example, are pressure sensors or the like that are placed on seats inside the inhabited space. When a person in the room sits down on a seat, that presence/absence sensor 6 detects the presence of that person. When there is a change in the sitting or absence of the person, or when a fixed period of time has passed, the presence/absence sensor 6 notifies the air conditioner control device 7 with information related to the presence or absence of the person through the wireless adapter 4 by wireless communication. The plurality of presence/absence sensors 6 is hereafter also referred to as a presence/absence sensor group 11.

Figure 2:
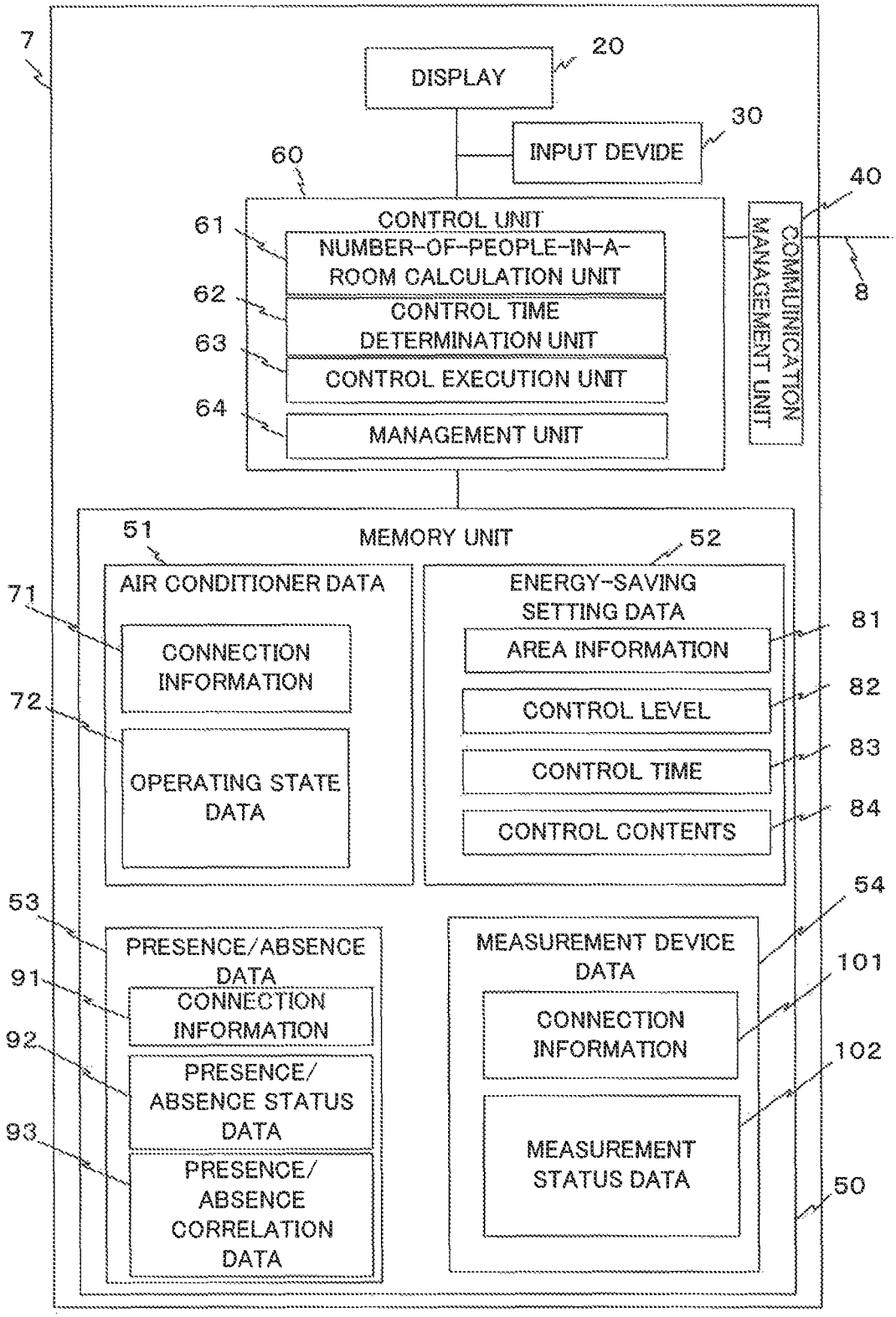
FIG. 2 is a block diagram illustrating the construction of the air conditioner control device in FIG. 1.
Figure 3:
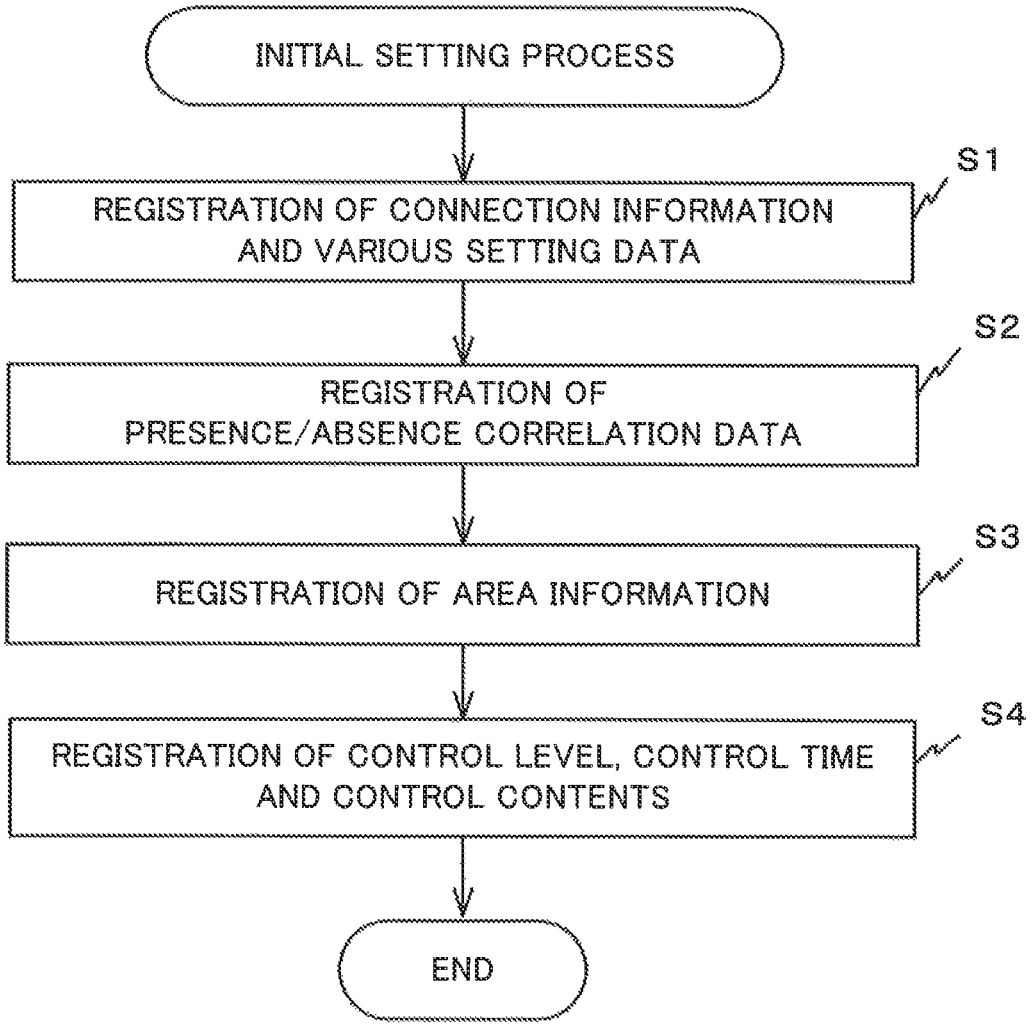
FIG. 3 is a flowchart of the initial setting process.

The air conditioner control device 7 controls and manages the air conditioner group 10 that includes the plurality of air conditioners (indoor units) 2. As illustrated in FIG. 2, the air conditioner control device 7 is provided with a display 20, an input device 30, a communication management unit 40, a memory unit 50 and a control unit 60.

The display 20 displays a monitoring screen and operation screen for monitoring the operating state and for operating each of the air conditioners (indoor units) 2 under the control of the control unit 60.

The input device 30 includes a touch panel, mouse, keyboard or the like. The touch panel is located on the display 20. When an administrator or the like operates the touch panel, mouse, keyboard or the like, a signal is outputted to the control unit 60 according to the contents of that operation (for example, an instruction to switch the monitoring screen, operation of the air conditioner group 10, various settings and the like).

The communication management unit 40 is a communication interface with the dedicated communication lines 8. Data is transmitted to and from the air conditioners (indoor units) 2 by way of the communication management unit 40.

The memory unit 50 stores various data necessary for the control unit 60 to perform control of the air conditioner group 10. The data stored by the memory unit 50 includes air conditioner data 51, energy-saving setting data 52, presence/absence data 53 and measurement device data 54.

Air conditioner data 51 includes connection information 71 for the connection of each air conditioner (indoor unit) 2, and operating state data 72 of each air conditioner (indoor unit) 2.

The connection information 71 is data necessary for controlling each of the air conditioners (indoor units) 2 such as the address number, operation group number, model type and the like of each air conditioner (indoor unit) 2 managed by the air conditioner control device 7.

The operating state data 72 is data that indicates the current operating state of the air conditioners (indoor units) 2 such as the ON/OFF state of the air conditioners, operating mode such as cooling or heating, the temperature setting, the indoor temperature and the like. The operating state data 72 is updated when necessary by transmitting data to and receiving data from the air conditioners (indoor units) 2.

The energy-saving setting data 52 includes area information 81, control level 82, control time 83 and control contents 84.

The area information 81 is data in which the air conditioners (indoor units) 2 that are managed by the air conditioner control device 7 are correlated with a plurality of respective areas that are divided into rooms, departments or the like.

The control level 82 includes threshold values for switching the control level. When the amount of electric power that is obtained from the electric power measurement device 3 exceeds a threshold value, the air conditioner control device 7 switches the control level of the air conditioner (indoor unit) 2.

The control time 83 is data that specifies the execution time for executing energy-saving control of the air conditioners (indoor units) 2 per a unit time. The control time 83 can be specified for each area or for each control level 82.

The control contents 84 is data that specifies details of the energy-saving control such as stop control, fan control, performance control and the like. The control contents 84 can be specified for each area or for each control level 82.

The presence/absence data 53 includes connection information 91, presence/absence status data 92 and presence/absence correlation data 93.

The connection information 91 includes address information of the wireless adapter 4 and presence/absence sensors 6 that detect the presence and absence, and various setting data for setting the wireless adapter 4 and presence/absence sensors 6.

The presence/absence status data 92 is data that indicates the status of people sitting, or the current absence state that is notified from the presence/absence sensor group 11. The presence/absence status data 92 is updated as necessary by exchanging data with the presence/absence sensors 6.

The presence/absence correlation data 93 is data that correlates each of the presence/absence sensors 6 with a respective air conditioner (indoor unit) 2 and manages the correlation. The presence/absence sensor 6 that senses people in a space that is air conditioned by an air conditioner (indoor unit) 2 is correlated with that air conditioner (indoor unit) 2.

The presence/absence status data 92 and the presence/absence correlation data 93 can also be said to indicate information related to people in spaces that are air conditioned by the air conditioners (indoor units) 2.

The measurement device data 54 includes connection information 101 and measurement status data 102.

The connection information 101 includes address information of the electric power measurement device 3 that measure the amount of electric power, and various setting data for setting the electric power measurement device 3.

The measurement status data 102 includes various measurement data that is obtained from the electric power measurement device 3 such as the amount of electric power, instantaneous power, voltage, current and the like.

The various data described above that is stored in the memory unit 50 is written and read as necessary by the control unit 60.

The control unit 60 is provided with a CPU and memory (neither is illustrated in the figure). The function of the control unit 60 is achieved by the CPU executing a program that is stored in the memory.

The control unit 60 controls the air conditioner group 10 that includes the air conditioners (indoor units) 2. The control unit 60 includes a number-of-people-in-a-room calculation unit 61, a control time determination unit 62, a control execution unit 63 and management unit 64.

The number-of-people-in-a-room calculation unit 61 calculates for each air conditioner (indoor unit) 2 the number of presence/absence sensors 6 that are correlated with the air conditioners (indoor units) 2 that indicate that a person is present based on presence/absence data 53 (presence/absence status data 92 and presence/absence correlation data 93) that is stored in the memory unit 50. The presence/absence data 53 is information about the people in spaces that are air conditioned by the air conditioners (indoor units) 2. Therefore, the number-of-people-in-a-room calculation unit 61 can also be said to calculate for each air conditioner (indoor unit) 2 the number of people in the space air conditioned by the air conditioner (indoor unit) 2 based on the presence/absence data 53.

The control time determination unit 62 obtains how many people are in spaces air conditioned by the air conditioners (indoor units) 2 according to the number of people present that was calculated by the number-of-people-in-a-room calculation unit 61. Then the control time determination unit 62 sets the ratio of control time of each air conditioner (indoor unit) 2 with respect to a unit time, with the control time that is specified by the control time 83 in the energy-saving setting data 52 as a reference. The control time determination unit 62 increases the control time based on this ratio, and sets the control time for which energy-saving control is to be executed for each air conditioner (indoor unit) 2.

The control execution unit 63 repeatedly executes energy-saving control during the control time for each air conditioner (indoor unit) 2 according to the set control time.

The management unit 64 manages various data that is stored in the memory unit 50 by reading or writing the various data above stored in the memory unit 50. Particularly, the management unit 64 also manages the presence/absence status data 92 and presence/absence correlation data 93, and can be said to manage information related to people in spaces that are air conditioned by the air conditioners (indoor units) 2.

More specifically, the management unit 64 collects presence/absence status data 92 about people detected by the presence/absence sensors 6. The management unit 64 then stores the presence/absence correlation data 93 in which the air conditioners (indoor units) 2 and presence/absence sensors 6 are correlated.

In this case, the number-of-people-in-a-room calculation unit 62 calculates the number of people in spaces that are air conditioned by the air conditioners (indoor units) 2 based on the presence/absence status 92 that is collected by the management unit 64 and presence/absence correlation data 93 that is stored by the management unit 64.

The control unit 60 also controls all of the component elements of the air conditioner control device 7.

Next, the operation of the air conditioner control device 7 will be explained.

(Initial Setting Process)

First, the initial setting process for setting various data in the memory unit 50 of the air conditioner control device 7 is explained.

After starting the air conditioning system 1, first, the management unit 64 of the control unit 60, according to operation input from the input device 30, registers connection information 71 for the air conditioners (indoor units) 2 that will be managed, connection information 91 for the wireless adapter 4 and presence/absence sensors 6, and connection information 101 for the electric power measurement device 3, and other various setting data in the memory unit 50 (step S1).

Next, the management unit 64, through operation input from the input device 30, registers the presence/absence sensors 6 that are located in spaces that are air conditioned by the air conditioners (indoor units) 2 as presence/absence correlation data 93 (step S2). The presence/absence correlation data 93 can also assign a plurality of presence/absence sensors 6 for an air conditioner (indoor unit) 2, or can assign a plurality of air conditioners (indoor units) 2 for a presence/absence sensor 6.

Figure 4:
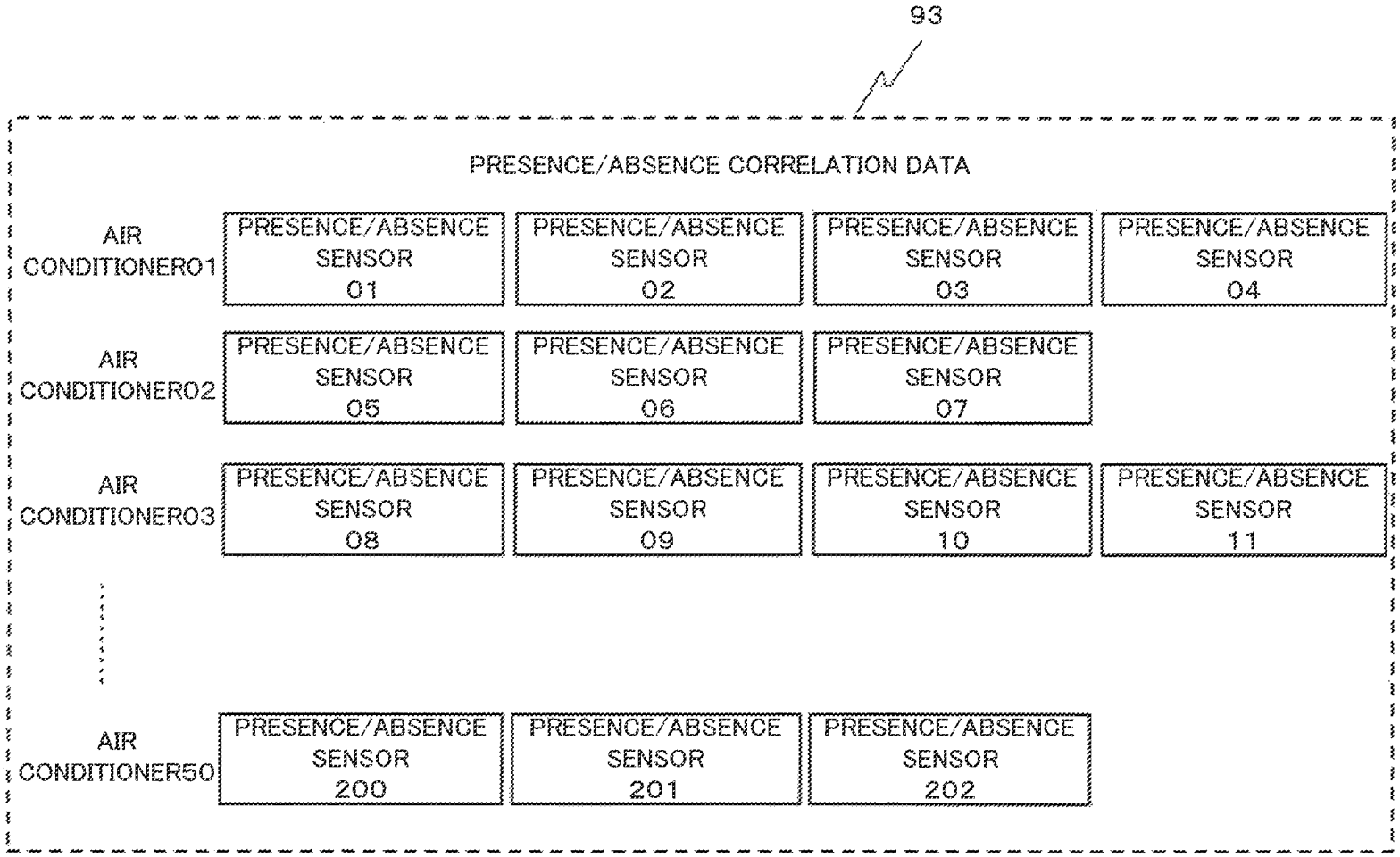
FIG. 4 is a drawing that schematically illustrates an example of presence/absence correlation data.

FIG. 4 schematically illustrates an example of presence/absence correlation data 93 that indicates which air conditioners (indoor units) 2 that a plurality of presence/absence sensors 6 is assigned to. In the presence/absence correlation data 93 illustrated in FIG. 4, presence/absence sensors 01 to 04 are correlated with air conditioner 01. Presence/absence sensors 05 to 07 are correlated with air conditioner 02. Moreover, presence/absence sensors 08 to 11 are correlated with air conditioner 03. Similar to this, respective presence/absence sensor are correlated with air conditioners 04 to 49. Finally, presence/absence sensors 200 to 202 are correlated with air conditioner 50.

Figure 5:
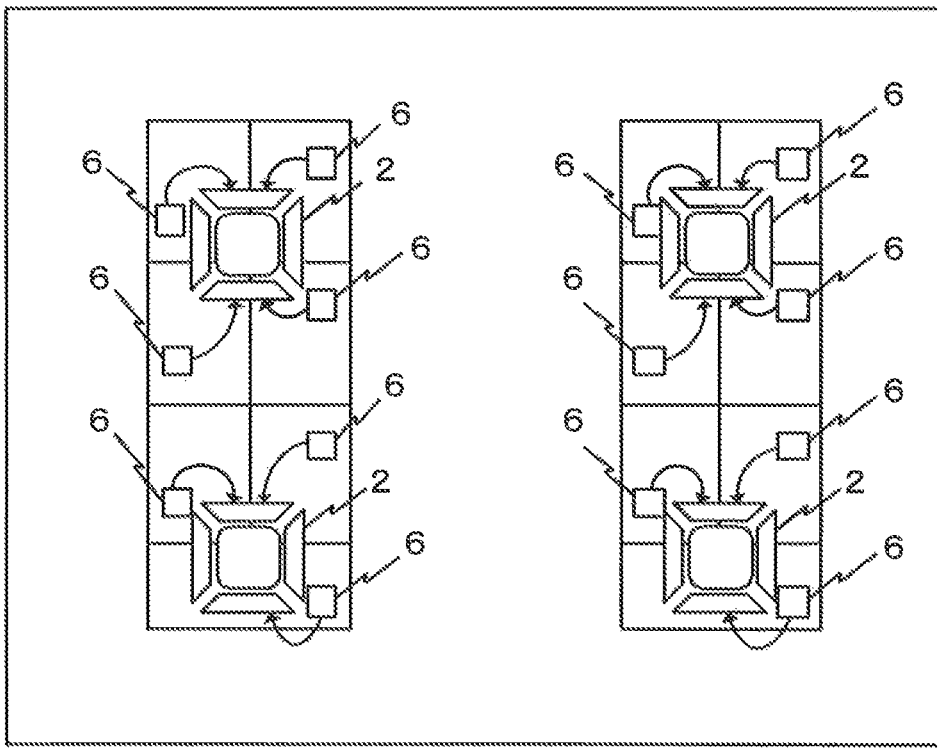
FIG. 5 is a drawing that schematically illustrates the correlation between a presence/absence sensor and an air conditioner.

FIG. 5 illustrates the relationship between each air conditioner (indoor unit) 2 and the presence/absence sensors 6. In FIG. 5, which air conditioner (indoor unit) 2 the presence/absence sensors 6, which are matched to the seating locations, are assigned to is illustrated using arrows. FIG. 4 collects this relationship in the form of a table.

Continuing, the management unit 64, through operation input from the input device 30, registers areas divided into rooms or department units as area information 81 (step S3). Each area is set so as to include at least one air conditioner (indoor unit) 2. It is also possible for one area to include a plurality of air conditioners (indoor units) 2.

Figure 6:
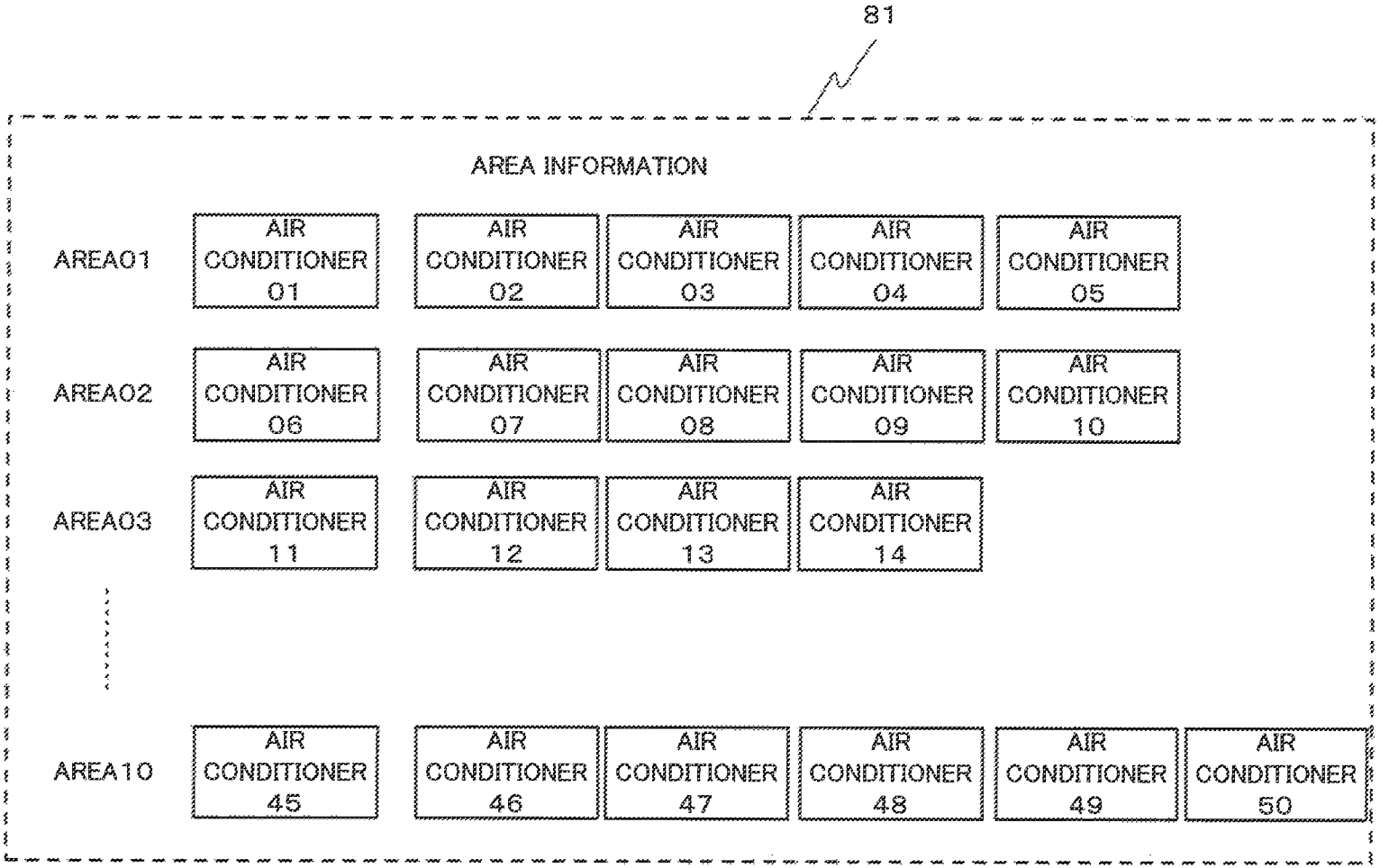
FIG. 6 is a drawing that schematically illustrates an example of area information.

FIG. 6 schematically illustrates an example of area information 81 in which a plurality of air conditioners (indoor units) 2 is correlated with areas. Each area is divided in room units or department units. In the area information 81 illustrated in FIG. 6, air conditioners 01 to 05 are correlated with area 01. Air conditioners 06 to 10 are correlated with area 02. Moreover, air conditioners 11 to 14 are correlated with area 03. Similar to this, air conditioners are correlated with areas 04 to 09. Furthermore, air conditioners 45 to 50 are correlated with area 10. In this embodiment, energy-saving control is cyclically executed for each area.

Next, the management unit 64 is such that through operation input from the input device 30, for each control level 82, the amount of time that energy-saving control is executed per unit of time (for example 3 minutes of control during 30 minutes) is set as the control time 83, and the control contents (stopping control, blower control, performance restrictions, and the like) are set as control contents 84 (step S4). The control level 82 is switched according to the amount of electric power obtained from the electric power measurement device 3. A user can register threshold values for switching the control level.

By performing the processing above, the initial setting process is complete.

Figure 7:
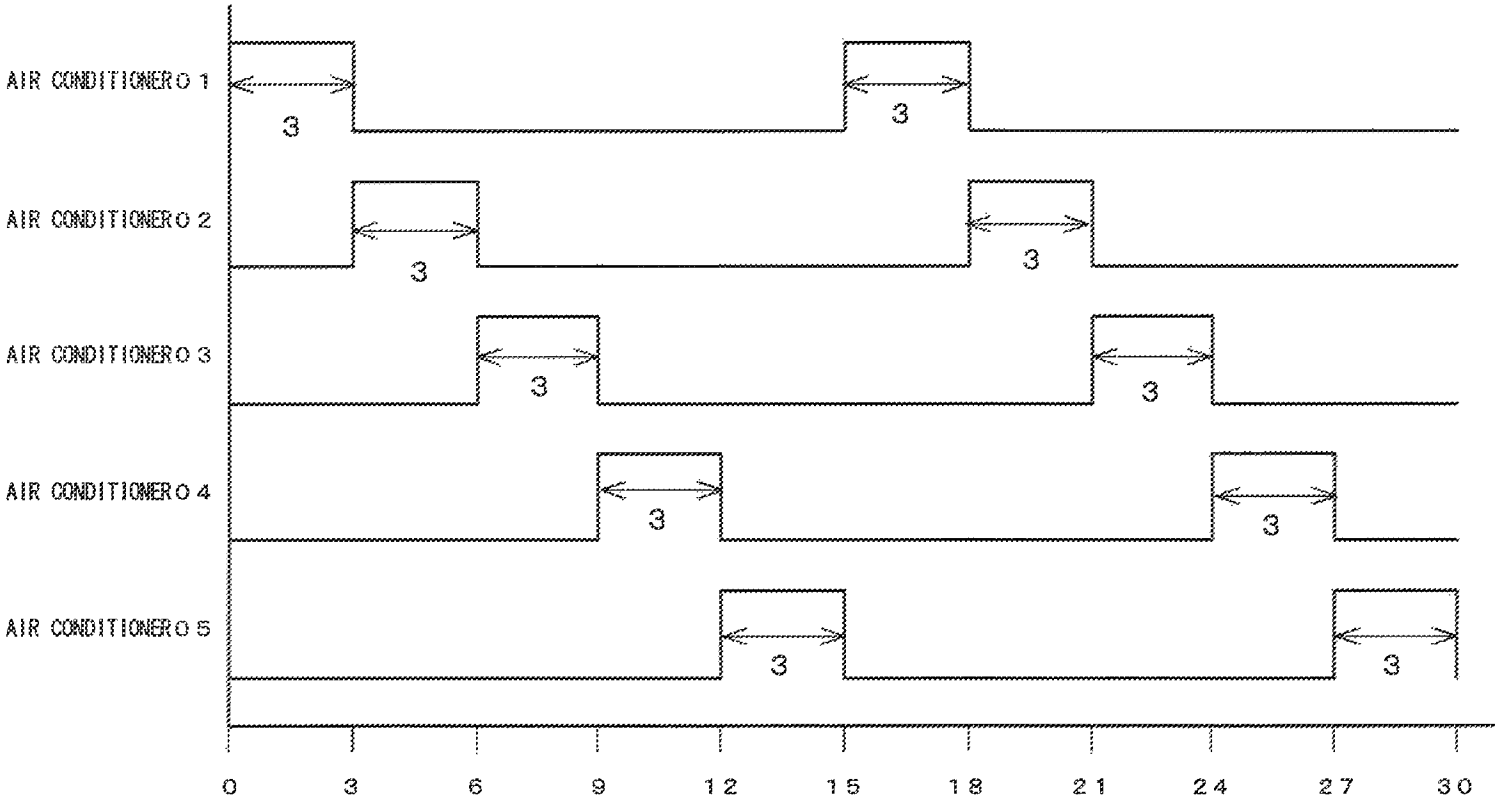
FIG. 7 is a timing chart of a reference ON/OFF pattern for energy-saving control.

FIG. 7 is an example of control when five air conditioners 01 to 05 are registered to one area, and the control time 83 for performing energy-saving control is registered as 6 minutes during a unit time (30 minutes). When the control time is 6 minutes, 3 minutes of energy-saving control is performed two times, and in this example, energy-saving control is performed for air conditioner 01 during minute 0 to 3, and during minute 15 to 18 for a total of 6 minutes. Energy-saving control is performed for air conditioner 02 during minute 3 to 6, and during minute 18 to 21 for a total of 6 minutes. Moreover, energy-saving control is performed for air conditioner 03 during minute 6 to 9, and during minute 21 to 24 for a total of 6 minutes. Energy-saving control is performed for air conditioner 04 during minute 9 to 12, and during minute 24 to 27 for a total of 6 minutes. Furthermore, energy-saving control is performed for air conditioner 05 during minute 12 to 15, and during minute 27 to 30 for a total of 6 minutes.

In this embodiment, the air conditioner control device 7 adjusts the control time for actual energy-saving control of the air conditioners 01 to 05. In other words, for the air conditioners 01 to 05, the actual control time may become shorter or less than 6 minutes depending on the number of people in an area.

Next, the control time calculation process of this embodiment will be explained with reference to FIG. 8.

Figure 8:
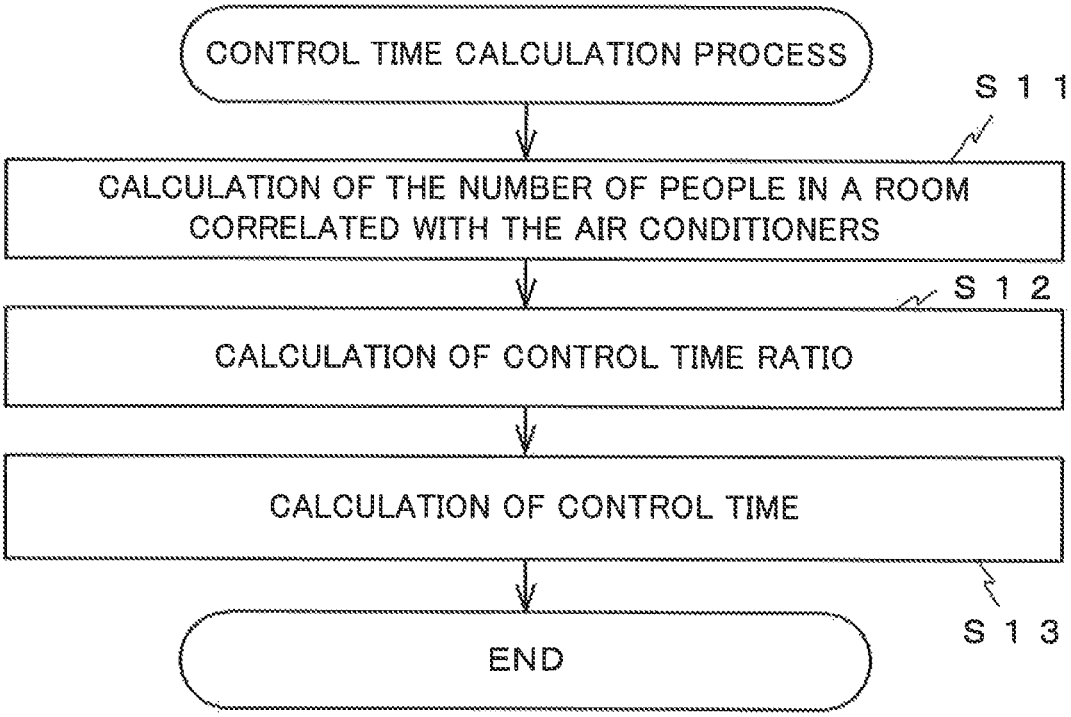
FIG. 8 is a flowchart of the process for calculating the control time.

FIG. 8 illustrates a flowchart of the control time calculation process for energy-saving control. This process is executed at the starting time (for example, at 0 minutes or at 30 minutes) for each unit time (for example 30 minutes). By executing this process, the control time for which energy-saving control is executed for each air conditioner (indoor unit) 2 is calculated based on the presence/absence status data 92.

First, the number-of-people-in-a-room calculation unit 61 calculates how many people are present for each air conditioner (indoor unit) 2 based on the presence/absence status data 92 and the presence/absence correlation data 93 (step S11).

Next, the control time determination unit 62 uses equation (1) below to calculate the ratio of control time according to the number of people correlated with each air conditioner (indoor unit) 2 in the same area (step S12).

$$\text{Ratio of control time} = (\text{total number of people inside an area} - \text{the number of people}) / \text{total of the}(\text{total number of people inside an area} - \text{the number of people}) \text{ of air conditioners inside an area} \quad (1)$$

Next, by calculating the ratio of the total control time of energy-saving control that is executed for the air conditioners (indoor units) 2 in an area using equation (2) below, it is possible to set the control time for performing energy-saving control (step S13).

$$\text{Control time} = \text{Total control time of energy-saving control of air conditioners in an area} \times \text{ratio of control time} \quad (2)$$

Here, an example of calculating the control time for the case in which the respective number of people for the five air conditioners 01 to 05 is the number of people as illustrated in FIG. 9.

As illustrated in FIG. 9 the number of people associated with air conditioner 01 is four people, the number of people correlated with air conditioner 02 is two people, the number of people correlated with air conditioner 03 is three people, the number of people correlated with air conditioner 04 is three people, and the number of people correlated with air conditioner 05 is zero. For this case, there are the total of 12 people in the area, and the sum total of (the total number of the people in the area−(minus) the number of the people) for each of the conditioners in the area is obtained as, (12−4)+(12−2)+(12−3)+(12−3)+(12−0)=48.

Therefore, with the equation above, the ratio of control time for air conditioner 01 is (12−4)/48, the ratio of control time for air conditioner 02 is (12−2)/48, the ratio of control time for air conditioner 03 is (12−3)/48, the ratio of control time for air conditioner 04 is (12−3)/48, and the ratio of control time for air conditioner 05 (12−0)/48. When the control time 83, which is a reference value of the energy-saving control, is registered as 6 minutes, the total control time for the air conditioners in the area is 6×5=30 minutes, and the value obtained by multiplying this value with the control time ratio is actual control time.

In this example, the energy-saving control time per of time for each air conditioner is 5.0 minutes for air conditioner 01, 6.25 minutes for air conditioner 02, 5.625 minutes for air conditioner 03, 5.625 minutes for air conditioner 04 and 7.5 minutes for air conditioner 05.

Figure 10:
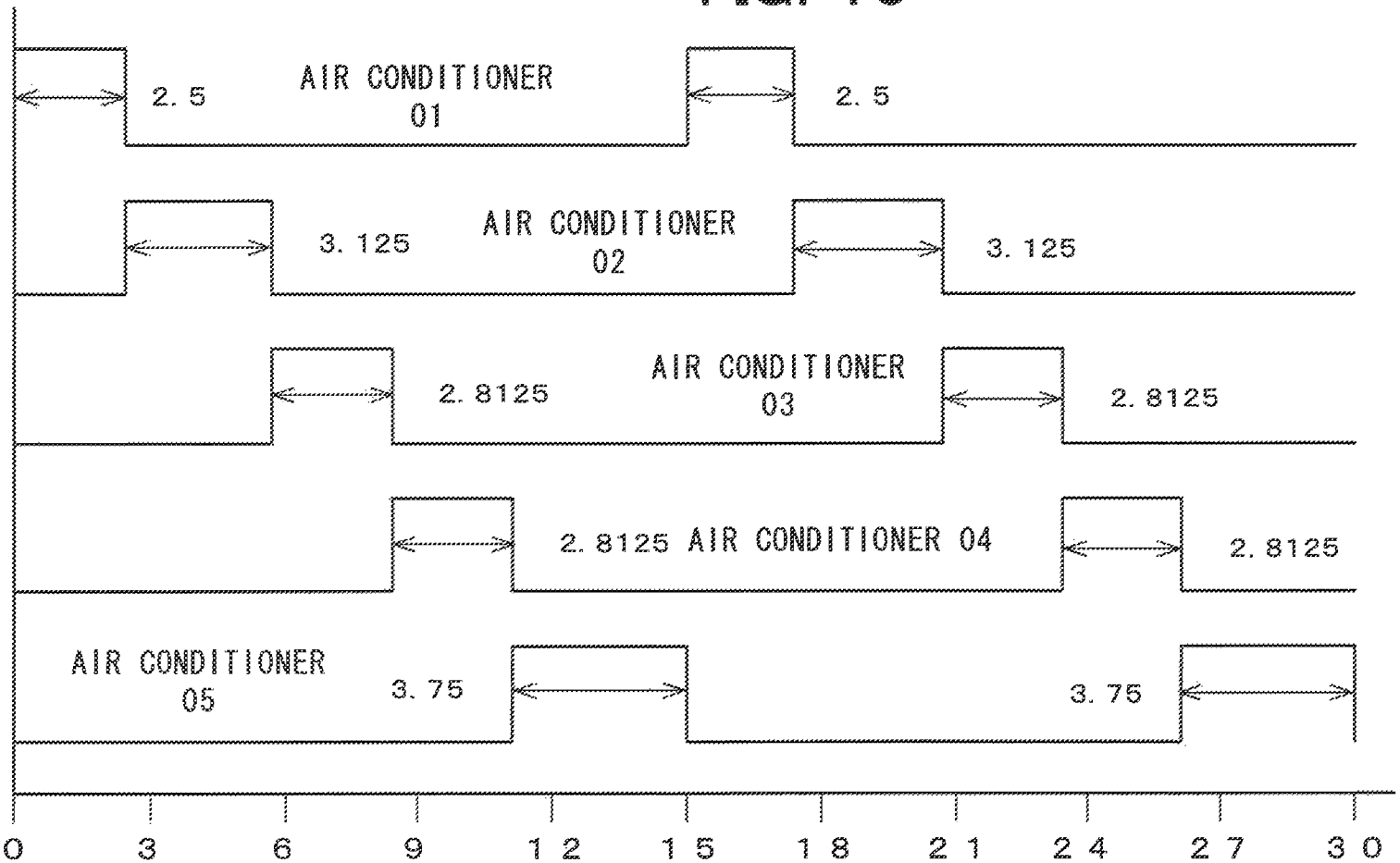
FIG. 10 is a timing chart illustrating an example of an ON/OFF pattern for energy-saving control in the air conditioning system in FIG. 1.

FIG. 10 illustrates a timing chart for the ON/OFF pattern of energy-saving control of air conditioners 01 to 05 that is executed during the control times found as described above. As illustrated in FIG. 10, by executing energy-saving control during a control time, it is possible to shorten the execution time for areas where there are many people, and thus it is possible to improve comfort.

Moreover, the total execution time for energy-saving control for all air conditioners in an area becomes the same as the value set by the administrator using the control time 83, so that it is possible to maintain the same amount of electric power reduction as in the case of conventional energy-saving control.

In this embodiment, the control time was found by using the equations above, however, it is also possible to use a method wherein priority is assigned using a control ratio, and the control time is determined by assigning patterns in one-minute units.

Moreover, in this embodiment, the presence/absence sensors 6 were connected wirelessly; however, the connection is not limited to being wireless, and it possible to connect the presence/absence sensors 6 directly to the dedicated communication lines 8, or to directly connect the sensors 6 to the air conditioner control device 7 using an LAN or the like.

Furthermore, in this embodiment, a method was employed by which an administrator inputted presence/absence correlation data 93 that correlated the presence/absence sensors 6 and air conditioners (indoor units) 2. However, it is also possible to use a method wherein position information about the air conditioners (indoor units) 2 and presence/absence sensors 6 are stored together with floor plan data inside the air conditioner control device 7, and the control unit 60 automatically generates presence/absence correlation data 93 from the position data.

As explained in detail above, with this embodiment, the control time during which energy-saving control is executed is increased or decreased according to the number of people, who act as heat sources, in spaces that are air conditioned by each of a plurality of air conditioners (indoor units) 2. In doing so, it is possible to reduce fluctuation in temperature due to energy-saving control without changing the amount of consumed electric power that is reduced regardless of the number of people in the spaces. As a result, it is possible to suppress a drop in comfort by air conditioning, while at the same time maintaining the effect of reducing the amount of electric power consumed by energy-saving control.

Moreover, the control time for performing energy-saving control of the air conditioners is determined according to the current presence/absence status. Therefore, even when the number of people differs over time, it is possible to determine the corresponding control time for executing optimum energy-saving control. By doing so, it is possible to improve the comfort in the air-conditioned room.

Embodiment 2

Next, a second embodiment of the present invention will be explained.

In the first embodiment described above, the presence/absence sensors 6 were special sensors, however, in this embodiment, information processing terminals that are located in the inhabited space, for example personal computers, are used to detect the presence or absence of people.

Figure 11:
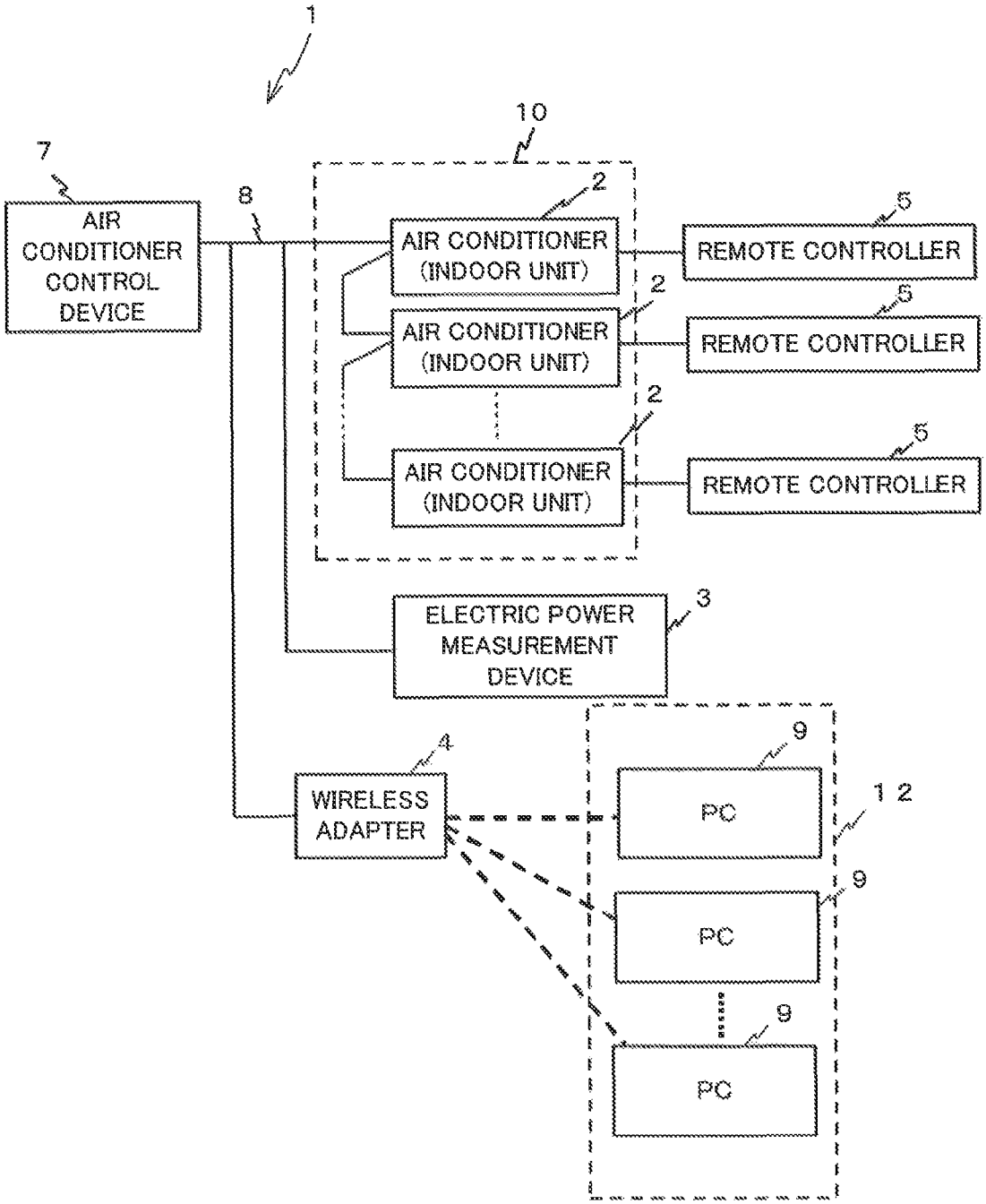
FIG. 11 is a block diagram illustrating the construction of an air conditioning system of a second embodiment of the present invention.

FIG. 11 illustrates an air conditioning system 1 of a second embodiment of the present invention. As illustrated FIG. 11, in the air conditioning system 1 of this second embodiment, personal computers (PC) 9 are provided instead of presence/absence sensors 6. A collection of a plurality of PCs 9 is also called a PC group 12.

In this embodiment, information related to the PCs 9 that are located in spaces air conditioned by the air conditioners (indoor units) 2 is stored in the memory unit 50 as presence/absence correlation data 93 of the presence/absence data 53.

Special software is installed in each PC 9. The PC 9 executes the special software and generates presence/absence information about people in the space according to whether or not there is operation input using the keyboard or mouse within a specified time, and transmits the information to the air conditioner control device 7 by way of a wireless adapter 4.

This transmission can be in the form of a response to a request from the air conditioner control device 7, or can be in the form of a notification when there was no operation input to the PC 9 within a fixed amount of time, or can be in the form of a periodic notification.

The air conditioner control device 7 receives this information, and when this information indicates that there was operation input, determines that there is a person near that PC 9, and when this information indicates that there was no operation input, and that the PC is in a standby state, determines that there is no person near the PC 9.

Moreover, it is possible to use various kinds of devices such as temperature sensors that operate by receiving an electric power supply from a USB terminal of the PC 9, and by the operation of the devices such as temperature sensors stopping when the power supply from the USB terminal stops when the PC 9 is in standby, the air conditioner control device 7 can determine that there is no person near the PC 9 whose operation has stopped.

In each of the embodiments above, the timing for determining the control time is after each unit of time (for example, every 30 minutes). However, the timing for determining the control time is not limited to this. It is also possible to use a method of determining the control time in real-time.

Furthermore, in this embodiments above, when there is a large number of people in a room, the control time during which energy-saving control of the air conditioners (indoor units) 2 is executed is shortened. However, shortening the control time is not limited to this, and it is possible to take into consideration the amount of heat generated by the number people, and to shorten the control time during which energy-saving control of the air conditioners (indoor units) 2 is executed the greater the number of people there are in the case of cooling. In the case of heating, it is possible to lengthen the control time during which energy-saving control of the air conditioners (indoor units) 2 is executed the greater the number of people there are.

In the embodiment above, the program that is executed can be distributed on a recording medium that can be read by a computer such as a flexible disk, CD-ROM (Compact Disk Read-Only Memory), DVD (Digital Versatile Disk), MO (Magneto-Optical Disk) or the like, and the system can be created by installing that program and executing the processing described above.

Moreover, it is possible to store the program in a disk device of a specified server on a communication network such as the Internet, and to download the program by superimposing the program on a carrier wave.

When achieving the functions above by sharing by the OS (Operating System), or by the OS and applications working together, it is possible to store just the part other than the OS on a recording medium and distribute that part, or to download that part to a computer.

Various embodiments and variations of the present invention are possible within the broad spirit and scope of the invention. The embodiments described above are for explaining the present invention and do not limit the scope of the invention. In other words, the scope of the present invention is as disclosed in the claims and not the embodiments. Moreover, various modifications and variations that are within the scope of the claims or within the scope of an equivalent invention are considered to be within the scope of the present invention.

This application is based on Japanese Patent Application No. 2010-233845, filed on Oct. 18, 2010. The entire specification, claims and drawings of Japanese Patent Application No. 2010-233845 are incorporated in this specification by reference.

INDUSTRIAL APPLICABILITY

The present invention is suitable for controlling the environment of an inhabited room where a plurality of air conditioners (indoor units) is installed.

DESCRIPTION OF REFERENCE NUMERALS

1 Air conditioning system
2 Air conditioner (indoor unit)
3 Electric power measurement device
4 Wireless adapter
5 Remote controller
6 Presence/absence sensor
7 Air conditioner control device
8 Dedicated communication line
9 Personal computer (PC)
10 Air conditioner group
11 Presence/absence sensor group
12 PC group
20 Display
30 input unit
40 Communication management unit
50 Memory unit
51 Air conditioner data
52 Energy-saving setting data
53 Presence/absence data
54 Measurement device data
60 Control unit
61 Number-of-people-in-a-room calculation unit
62 Control time determination unit
63 Control execution unit
64 Management unit
71 Connection information
72 Operating state data
81 Area information
82 Control level
83 Control time
84 Control contents
91 Connection information
92 Presence/absence status data
93 Presence/absence correlation data
101 Connection information
102 Measurement status data

The invention claimed is:

1. An air conditioner control device that controls a plurality of air conditioners that are installed at different positions in a specified inhabited space, comprising:

a management unit that manages information related to people in spaces air conditioned by each of the air conditioners;

a number-of-people-in-a-room calculation unit that calculates, for each air conditioner, the number of people in a space that is air conditioned by an air conditioner based on the information related to people in the space that is managed by the management unit;

a control time determination unit that reduces or increases a control time during which energy-saving control of each of the air conditioners is executed according to the number of people in a space that was calculated by the number-of-people-in-a-room calculation unit so that a total of the control times for the plurality of air conditioners is maintained to be a predetermined time, while a control time for one air conditioner is reduced and another control time for another air conditioner is increased among the control times for the plurality of air conditioners; and a control execution unit that repeatedly executes energy-saving control for each of the air conditioners according to the control time that is reduced or increased by the control time determination unit.

2. The air conditioner control device according to claim 1, wherein the control time determination unit during cooling shortens the control time for each of the air conditioners the greater the number of people there are in a space, which is calculated by the number-of-people-in-a-room calculation unit; and during heating lengthens the control time for each of the air conditioners the greater the number of people there are in a space, which is calculated by the number-of-people-in-a-room calculation unit.

3. The air conditioner control device according to claim 1, further comprising a plurality of presence/absence detectors that detects presence/absence of people in a vicinity of the presence/absence detectors, wherein the management unit collects presence/absence information about people detected by presence/absence detectors, and stores correlated information that correlates the air conditioners with the respective presence/absence detectors; and the number-of-people-in-a-room calculation unit calculates the number of people in spaces that are air conditioned by the air conditioners based on the presence/absence information that was collected by the management unit and the correlated information that is stored by the management unit.

4. The air conditioner control device according to claim 3, wherein the presence/absence detector is an information terminal that generates presence/absence information about people in a space according to whether or not there is operation input within a specified period of time, and transmits that information to the air conditioner control device.

5. An air conditioner control method of controlling a plurality of air conditioners that are installed at different positions in a specified inhabited space, comprising:

a management step of managing information related to people in spaces air conditioned by each of the air conditioners;

a number of people in a room calculation step of calculating, for each air conditioner, the number of people in a space that is air conditioned by an air conditioner based on the information related to people in the space that is managed by the management step;

a control time determination step of reducing or increasing a control time during which energy-saving control of each of the air conditioners is executed according to the number people in a space that was calculated by the number of people in a room calculation step so that a total of the control times for the plurality of air conditioners is maintained to be a predetermined time, while a control time for one air conditioner is reduced and another control time for another air conditioner is increased among the control times for the plurality of air conditioners; and a control execution step of repeatedly executing energy-saving control for each of the air conditioners according to the control time that is reduced or increased by the control time determination step.

6. A non-transitory computer readable recording medium on which is recorded a program that causes a computer that controls a plurality of air conditioners that are installed at different positions in a specified inhabited space to function as:

a management unit that manages information related to people in spaces air conditioned by each of the air conditioners;

a number-of-people-in-a-room calculation unit that calculates, for each air conditioner, the number of people who are in a space that is air conditioned by an air conditioner based on the information related to people in the space that is managed by the management unit;

a control time determination unit that reduces or increases a control time during which energy-saving control of each of the air conditioners is executed according to the number of people who are in a space that was calculated by the number-of-people-in-a-room calculation unit so that a total of the control times for the plurality of air conditioners is maintained to be a predetermined time, while a control time for one air conditioner is reduced and another control time for another air conditioner is increased among the control times for the plurality of air conditioners; and a control execution unit that repeatedly executes energy-saving control for each of the air conditioners according to the control time that is reduced or increased by the control time determination unit.

* * * * *